United States Patent [19]

Birkle

[11] 4,247,744

[45] Jan. 27, 1981

[54] LIMIT SWITCH

[76] Inventor: Paul G. Birkle, 4201 S. 78th St., Milwaukee, Wis. 53220

[21] Appl. No.: 7,892

[22] Filed: Jan. 31, 1979

[51] Int. Cl.[3] ..... H01H 3/16

[52] U.S. Cl. ..... 200/47; 200/153 T

[58] Field of Search ..... 200/47, 153 T; 318/282

[56] References Cited

U.S. PATENT DOCUMENTS

| | | | |
|---|---|---|---|
| 1,151,990 | 8/1915 | Balzer | 318/282 X |
| 2,431,929 | 12/1947 | Goff | 200/47 X |
| 2,951,920 | 9/1960 | Miller | 200/47 |
| 2,964,601 | 12/1960 | Stockwell | 200/47 |
| 3,825,809 | 7/1974 | Gatland et al. | 200/47 X |

*Primary Examiner*—Stephen Marcus

*Attorney, Agent, or Firm*—Michael, Best & Friedrich

[57] ABSTRACT

A limit switch comprises a frame having an elongated extruded metallic base, a lead screw shaft supported on the frame and coupled with a drive source for rotation, and a pair of control discs threadably engaged upon the lead screw shaft and restrained from rotation therewith, such that rotation of the lead screw shaft causes the control discs to axially advance along the shaft. Switch assemblies are carried by the base and located in the path of axial advancement of the control discs for operation in repsonse to selective engagement with and disengagement from the control discs. The control discs are individually adjustable along the lead screw shaft, and the switch assemblies are individually adjustable along the base, to thereby permit a wide range of operation for the limit switch.

15 Claims, 6 Drawing Figures

SOURCE

C
A
B

SOURCE
MODE 2
MODE 1

Fig. 2.
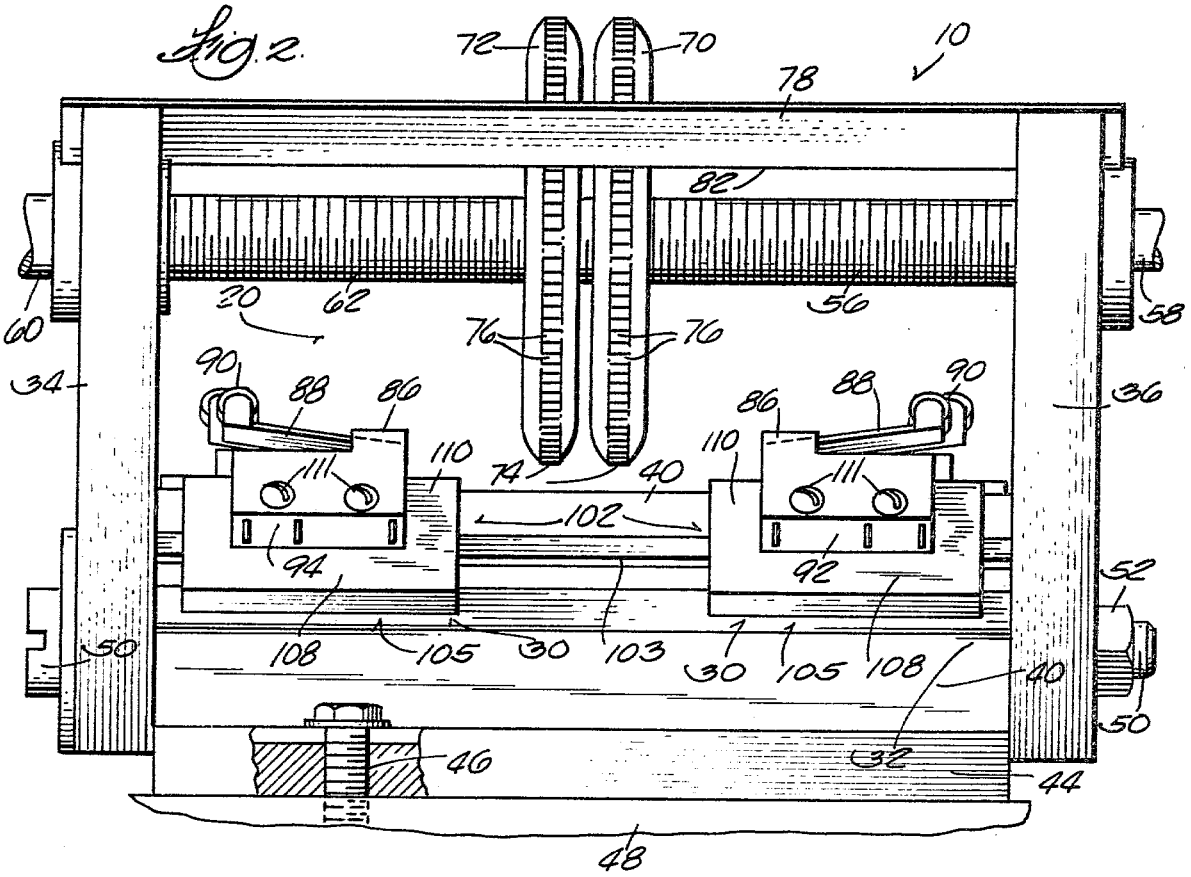
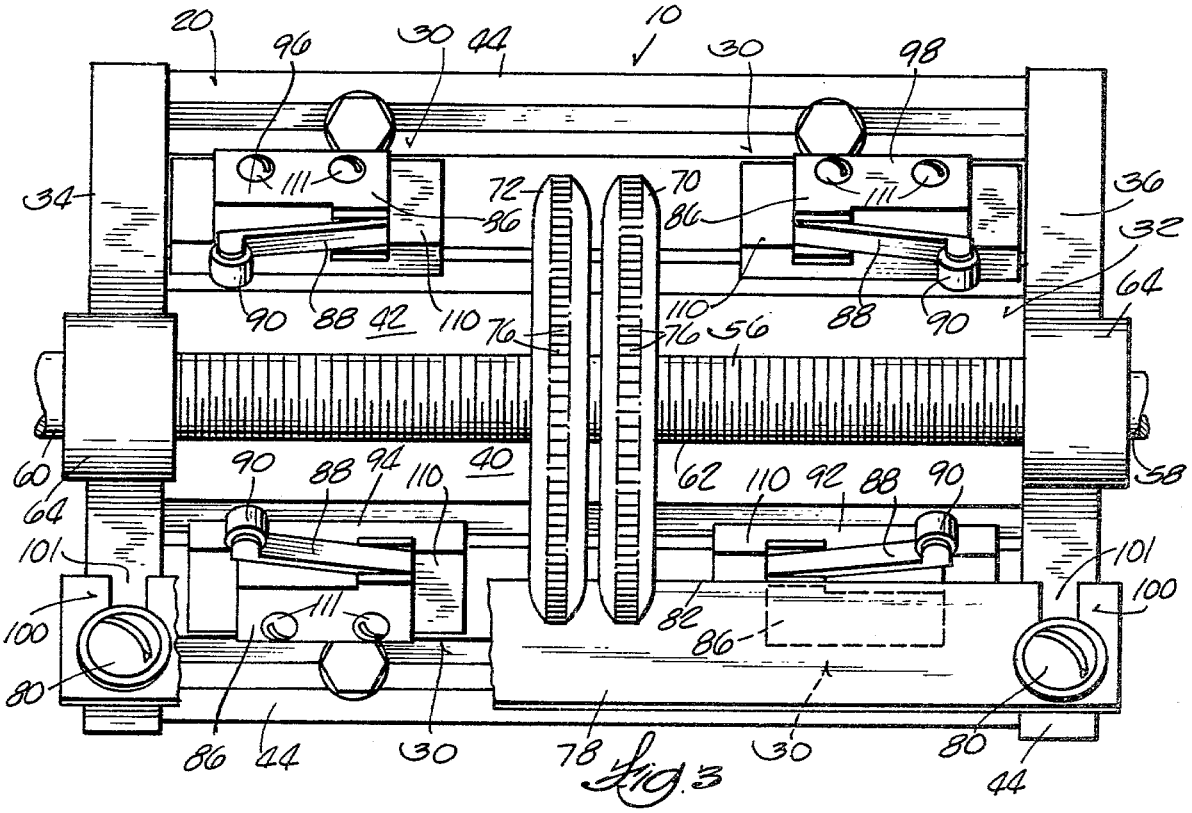
Fig. 3

LIMIT SWITCH

BACKGROUND OF THE INVENTION

I. Field of the Invention

The invention relates to limit switches, and more particularly to rotary limit switches used for controlling the operation of reversible electric motors.

II. Description of the Prior Art

Limit switches are known which include a rotatably mounted lead screw shaft and a pair of actuating discs which axially advance on the screw shaft and make selective contact with and thereby operate adjacently mounted switches. Representative examples of prior art limit switches are disclosed in the following U.S. Pat. Nos.

Miller 2,951,920; Sept. 6, 1960;
Stockwell 2,964,601; Dec. 13, 1960;
Schaefer 3,175,418; Mar. 30, 1965;
Delaney 3,474,317; Oct. 21, 1969;
Ross 3,582,629; June 1, 1971;
Bur 3,714,537; Jan. 30, 1973;
Dalton 3,715,530; Feb. 6, 1973;
Gatland, et al 3,825,809; July 23, 1974;
Day 3,984,646; Oct. 5, 1976.

It is desirable for a limit switch to be versatile enough to conform to the differing operational objectives of the diverse types of power actuated equipment which presently incorporate a limit switch function. It is also desirable to couple this versatility with simplicity of construction.

The limit switches disclosed in Miller, Schaefer, Delaney, and Gatland are to some extent versatile, in that the positions of the actuator discs can be independently adjusted along the lead screw shaft. However, the versatility of these disclosed limit switches is circumscribed by the presence of associated switch assemblies which are fixedly attached to the frame and not capable of being adjusted.

The limit switch disclosed by Stockwell includes one switch assembly which is adjustable inside a housing. However, in Stockwell, the other switch assembly is fixedly attached to the frame and immobile. Furthermore, the limited versatility of Stockwell's limit switch is overshadowed by its mechanical complexity.

SUMMARY OF THE INVENTION

One of the objects of this invention is to provide a limit switch which couples versatility of operation with overall simplicity of construction.

Another one of the objects of this invention is to provide a limit switch on which the actuator discs and all of the associated switch assemblies are independently adjustable to permit a wide range of operation for the limit switch.

To accomplish these and other objectives, the invention provides a limit switch comprising a frame member, lead screw means supported on and rotatable relative to the frame member, and coupling means for connecting the lead screw means to a drive source for rotating the lead screw means. Control means is threadably engaged upon the lead screw means, and retaining means is operatively engaged with the control means for preventing rotation of the control means with the lead screw means while permitting axial advancement of the control means along the lead screw means in response to rotation of the lead screw means. Switching means is located in the path of axial advancement of the control means for operation between a first switch position and a second switch position in response to selective engagement with and disengagement from the control means. The limit switch includes first adjusting means for permitting selective positioning of the control means along the lead screw means, as well as second adjusting means for permitting selective positioning of the switching means along the path of axial advancement of the control means. By virtue of the first and second adjusting means, the control means and the switching means are independently adjustable to permit a wide range of operation for the limit switch.

In the preferred embodiment, the lead screw means includes a lead screw shaft supported on the frame member for rotation, and the control means includes first and second actuator discs threadably engaging the lead screw shaft in a normally spaced-apart relationship to each other. Each of the first and second actuator discs has an outer perimeter edge including a plurality of axial slots generally spaced about the circumference thereof. In this embodiment, the retainer means includes a guide plate mounted on the frame, being positioned generally longitudinally along and spaced from the lead screw shaft. The guide plate includes a leading edge portion movable between an engaged position and a disengaged position with one of the axial slots on each of the actuator discs. When in the engaged position, rotation of the first and second actuator discs with the lead screw shaft is prevented, while sliding movement of the engaged axial slots along the leading edge portion is permitted as the rotationally restrained first and second actuator discs synchronously advance axially along the lead screw shaft in response to rotation of the lead screw shaft. When in the disengaged position, independent rotation of each of the first and second actuator discs relative to the lead screw shaft is permitted, which thereby permits individual positioning of each actuator disc along the lead screw shaft.

Also in the preferred embodiment, the frame member includes an elongated extruded metallic base member having first and second generally sloping leg members which thereby define an inverted V-shaped form. Each of the first and second leg members includes an integral flanged foot running longitudinally along the entirety of the metallic base. Oppositely spaced sidewalls are attached on and extend upwardly from the metallic base member, and the lead screw shaft is rotatably supported transverse the sidewalls. In this embodiment, the second adjusting means includes a first groove and a second groove integral with and disposed longitudinally along the entirety of, respectively, the first and second leg members. A first runner member and a second runner member are included, each having a lower body portion slidably engaged with the first groove and an integral upper body portion extending outwardly beyond the first groove. Similarly, a third runner member and a fourth runner member are slidably engaged with the second groove.

The switching means includes a first switch assembly attached to the upper body portion of the first runner member and positioned intermediate the first actuator disc and the adjacent sidewall. A second switch assembly is attached to the upper body portion of the second runner member and positioned intermediate the second actuator disc and the adjacent sidewall. In like fashion, a third switch assembly is attached to the upper body portion of the third runner member and positioned in close vicinity of the first switch member; and a fourth switch assembly is attached to the upper body portion of the fourth runner member and positioned in close vicinity of the second switch member. By virtue of this construction, the limit switch includes four associated switch assemblies, each of which is positioned for selective engagement with and disengagement from one of the actuator discs, and each of which is individually adjustable upon the associated runner member along the path of engagement.

In the preferred embodiment, locking means is provided for each of the runner members for selectively preventing sliding movement of the respective one of the runner members with the respective one of the grooves and for freeing the respective runner member for the sliding movement within the respective groove.

Other objects and advantages will be pointed out in, or be apparent from, the specification and claims, as will obvious modifications of the embodiment shown in the drawings.

BRIEF DESCRIPTION OF THE DRAWINGS

FIG. 2 is a front view of the limit switch shown in FIG. 1;

FIG. 3 is a top view of the limit switch shown in FIG. 1;

GENERAL DESCRIPTION

Figure 1:
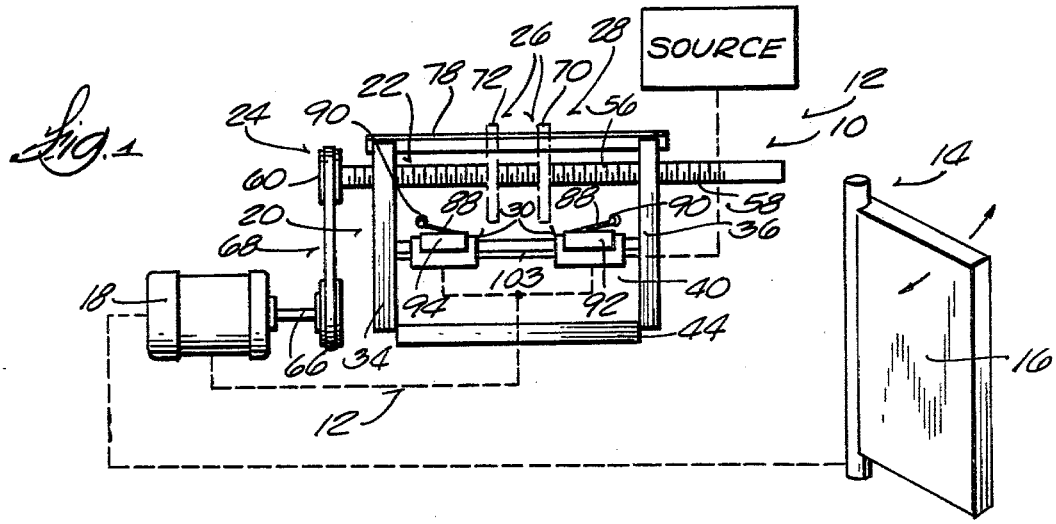
FIG. 1 is a diagrammatic view of a limit switch which embodies features of the invention.

A limit switch 10 which embodies the features of the invention is shown in FIG. 1. The invention perhaps finds its widest application as part of an electrical control circuit 12 which interconnects a source of electrical energy with a power actuated device 14, and the invention will hereafter be described in this environment. However, it should be appreciated that the limit switch 10 is also applicable for use in other environments.

In this environment, the power actuated device 14 is typically of a type which is operable between two opposite operational end positions, such as a door 16 which is movable between a fully opened position and a fully closed position (as shown in FIG. 1). The electrical control circuit 12 typically includes a reversible electric motor 18 which powers the door 16 between its two operational end positions. In this context, the limit switch 10 regulates the flow of electrical energy to the motor 18 such that, as soon as the door 16 has reached one of its operational end positions, the subsequent flow of electrical energy to the motor 18 is prevented. In this way, "overtravel" of the door 16 beyond either of its two operational extremes is prevented, which reduces the chance of mechanical jamming and failure.

Basically, the limit switch 10 includes a frame member 20, lead screw means 22 which is rotatably supported on the frame member 20, and coupling means 24 which operatively connects the lead screw means 22 with the motor 18 to rotate the lead screw means 22 simultaneously with the operation of the door 16. Control means 26 is threadably engaged upon the lead screw means 22, and retainer means 28 engages the control means 26 to prevent common rotation of the control means 26 with the lead screw means 22 and to permit the rotatably restrained control means 26 to axially advance along the rotating lead screw means 22 as the door 16 is being operated by the motor 18.

Switching means 30 is electrically interconnected with the control circuit 12 and is mounted on the frame member 20 so as to be in the path of axial advancement of the control means 26. The control means 26 thus successively engages and disengages the switching means 30 during the course of its axial advancement along the lead screw means 22, thereby operating the switching means 30 to regulate the flow of electrical energy through the control circuit 12.

Figure 4:
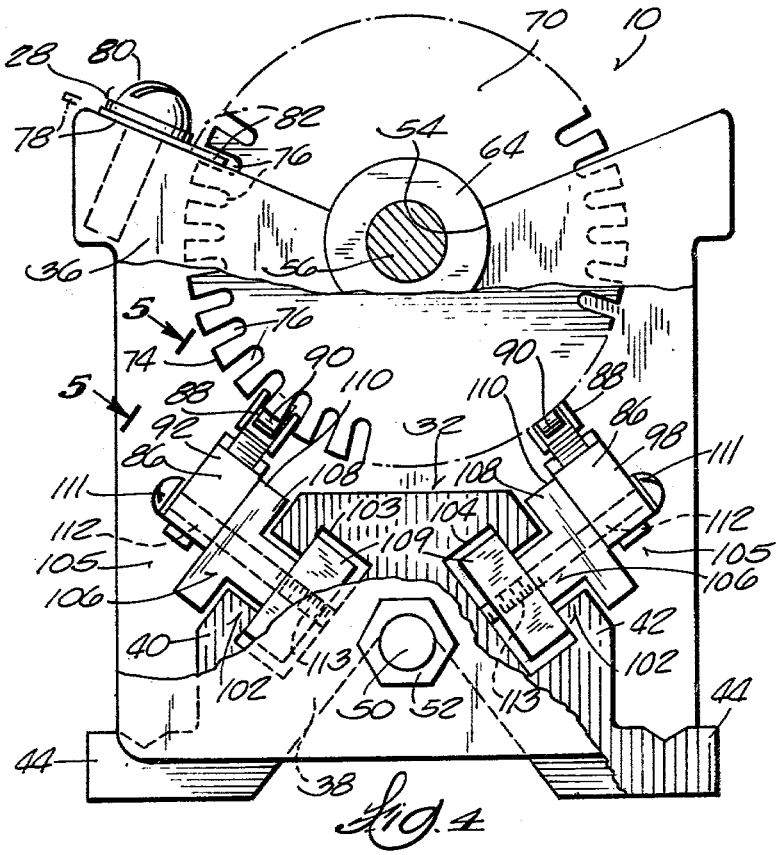
FIG. 4 is a partially broken away end view of the limit shown in FIG. 1.

Referring now to FIGS. 2 through 4, in which the particular structure of the limit switch 10 is shown, the frame member 20 includes a base portion 32 and two separately affixed sidewalls 34 and 36. For description purposes, the sidewalls will hereafter be referred to, respectively, as left and right sidewalls 34 and 36, although it should be appreciated that the operation of the limit switch 10 is not affected by the particular horizontal, vertical, or intermediate angular disposition of the surface upon which the limit switch 10 is mounted.

While the construction of the base portion 32 can vary, in the illustrated embodiment (as best shown in FIG. 4), the base 32 is formed of an elongated metallic member 38 of one piece, extruded construction. The metallic member 38 defines a generally inverted V-shape, having two divergingly sloped leg members 40 and 42, each having an integral flanged foot 44 running longitudinally along the entirety of the respective leg member 40 or 42. Holes 46 may be drilled through each flanged foot 44 at spaced intervals (see FIG. 2) so that the frame member 20 may be bolted or otherwise affixed to a suitable surface area 48.

The sidewalls 34 and 36 are assembled upon the base 32 by means of a longitudinal mounting bolt 50 and associated nut 52. As shown in FIG. 4, each sidewall 34 and 36 includes a symmetric, generally V-shaped notch 54 along its uppermost edge, and each sidewall 34 and 36 is affixed to the base 32 such that the apex of V-shaped notch 54 generally aligns with the apex of the inverted V-shaped base 32.

As is best shown in FIGS. 2 and 3, the lead screw means 22 includes a lead screw shaft 56 having opposite first and second end portions 58 and 60 and an intermediate externally threaded portion 62. The first and second end portions 58 and 60 rest in the respective V-shaped notches 54, and suitable journal bearings 64 are provided at this junction to permit rotation of the lead screw shaft 56 and to prevent axial displacement of the lead screw shaft 56 on the frame member 20. By virtue of this construction, the leg members 40 and 42 are oppositely spaced along and equidistant to the axis of rotation of the lead screw shaft 56 (as best seen in FIGS. 3 and 4).

Referring now to FIG. 1, the reversible electric motor 18 includes an output shaft 66 suitably connected to one end portion 60 of the lead screw shaft 56, e.g. by means of a suitable belt drive assembly 68 or the like. The motor 18 is also suitably coupled to the door 16 (shown schematically in FIG. 1) to operate it. Thus, the motor 18 simultaneously rotates the lead screw shaft 56 and operates the door 16. By virtue of this construction, the lead screw shaft 56 will be rotated either in a clockwise or a counterclockwise direction, depending upon the particular operational mode of the electric motor 18. In the illustrated embodiment, when the motor 18 is opening the door 16 (hereafter referred to as the first operational mode), the lead screw shaft 56 is rotated in a clockwise direction. Likewise, when the motor 18 is closing the door 16 (hereafter referred to as the second operational mode), the lead screw shaft 56 is rotated in the opposite, or counterclockwise, direction.

Referring next to the control means 26, as is best shown in FIGS. 2 and 3, first and second actuator discs 70 and 72 are threadably engaged upon the externally threaded portion 62 of the lead screw shaft 56. In the illustrated embodiment, the two actuator discs 70 and 72 are disposed in a generally spaced-apart relationship such that the first actuator disc 70 is between the second disc 72 and the right sidewall 36, and the second actuator disc 72 is between the first actuator disc 70 and the left sidewall 34.

As best seen in FIG. 4, each actuator disc 70 and 72 has an outer perimeter edge 74 which includes one or more axial slots 76 positioned about the circumference thereof. The retainer means 28 engages these slots 76. In particular, the retainer means 28 includes a guide plate 78 which is fastened by suitable screw bolts 80 on the frame member 20 and which is generally coextensive with and spaced from the externally threaded portion 62 of the lead screw shaft 56 (see also FIG. 3). The guide plate 78 includes a leading edge portion 82 which is adapted to concurrently engage one slot 76 in each of the actuator discs 70 and 72.

When the leading edge portion 82 and the slots 76 are engaged, each actuator disc 70 and 72 is physically prevented from rotating in common with the lead screw shaft 56. However, by virtue of the axial construction of the slots 76, longitudinal sliding movement of the slots 76 along the leading edge 82 is permitted as the actuator discs 70 and 72, being restrained from rotating with the lead screw shaft 56, synchronously advance along the rotating lead screw shaft 56. The direction of axial advancement of the actuator discs 70 and 72 depends upon the direction of rotation of the lead screw shaft 56. That is, as the lead screw shaft 56 is rotated clockwise (the motor 18 being operated in the first mode), the actuator discs 70 and 72 synchronously advance toward the right sidewall 36, and as the lead screw shaft 56 is rotated counterclockwise (the motor 18 being operated in the second mode), the actuator discs 70 and 72 synchronously advance toward the left sidewall 34.

Figure 5:
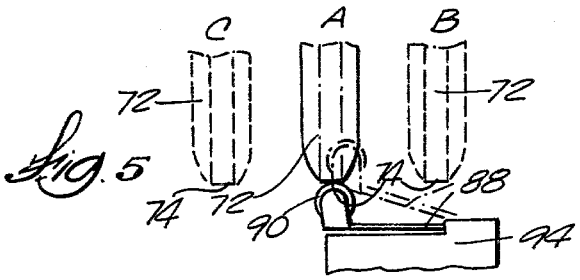
FIG. 5 is an exploded view of one of the switch assemblies and one of the actuator discs of the limit switch taken generally along line 5—5 of FIG. 4.

Referring now to the particular structure of the switching means 30 and its interaction with the axially advancing actuator discs 70 and 72 (as are best seen in FIGS. 2, 3, and 5), four switch assemblies 92, 94, 96, and 98 are carried by the base portion 32. Each switch assembly 92, 94, 96, and 98 is of identical mechanical construction, although the internal electrical configuration and, thus, the desired electrical effect of operating each switch assembly 92, 94, 96, and 98 can vary according to the operational objectives of the particular limit switch 10. In particular, each switch assembly 92, 94, 96 and 98 includes a switch body 86 which houses the electrical components and a switch arm 88 pivotally attached to the switch body 86 and interconnected with the internal electrical components of the switch assembly 84. The switch arm 88 is biased to a first position (shown in phantom lines in FIG. 5 and in solid lines in FIGS. 1 through 4) in which the arm 88 extends upwardly from the switch body 86 and in which a certain predetermined electrical effect occurs, and is movable against the bias to a second position (shown in solid lines in FIG. 5), in which the arm 88 is downwardly depressed from its first position and in which a different predetermined electrical effect occurs. As seen in FIG. 5, each switch arm 88 includes a roller actuator 90 rotatably affixed to the outermost edge of the arm 88.

As is best seen in FIGS. 2 and 4, each of the switch assemblies 92, 94, 96 and 98 is positioned upon the base portion 32 such that each switch arm 88 lies in the path of axial advancement of the perimeter edges 74 of the actuator discs 70 and 72. The engagement of one of the perimeter edges 74 with one of the switch arms 88, and more particularly, as the perimeter edge 74 of one of the actuator discs 70 or 72 rides up on the roller member 90 (as shown in solid lines as position A in FIG. 5) displaces the switch arm 88 downwardly from its normal first position to its second position. Likewise, the eventual disengagement of the perimeter edge 74 with the roller actuator 90 frees the switch arm 88 to return to its normal first position, as the particular actuator disc 70 or 72 either axially advances in an opposite direction and thus "backs off" the roller actuator 90 (as shown in phantom lines as position B in FIG. 5) or advances in an unchanged direction and thus "rides over" the roller actuator 90 (as shown in phantom lines as position C in FIG. 5).

Figure 6:
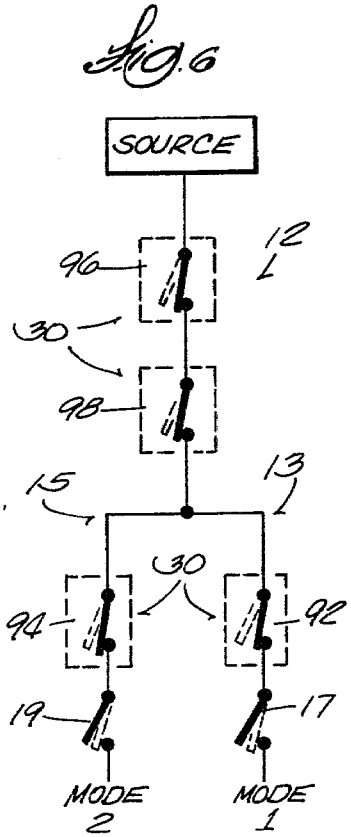
FIG. 6 is a block diagram of the circuit shown in FIG. 1.

As before discussed, the limit switch 10 can be interconnected in the electrical control circuit 12 to regulate the operation of the reversible electric motor 18 such that the electric motor 18 is operable within predetermined limits in each operational mode. While the configuration of the electrical circuitry to accomplish this function may vary, in the particular electrical circuit embodiment illustrated in FIG. 6, the control circuit 12 comprises two circuits 13 and 15 connected in parallel relation with the source. The first circuit 13 is operable to provide electrical energy to operate the motor 18 in the first mode, thereby simultaneously opening the door 16 and rotating the lead screw shaft 56 in the clockwise direction. The second circuit 15 is operable to provide electrical energy to operate the motor 18 in the second mode, thereby simultaneously closing the door 16 and rotating the lead screw shaft 56 in the counterclockwise direction.

The first and second mode circuits 13 and 15 include, respectively, first and second mode master control switches 17 and 19 movable by the operator between a normally biased open position (as shown in solid lines in FIG. 6) which prevents the flow of electrical energy through the respective control circuit 13 or 15, and a closed position (as shown in phantom lines in FIG. 6) which permits the flow of electrical energy through the respective control circuit 13 or 15.

In this embodiment, the switching means 30 includes first and second switch assemblies 92 and 94 as heretofore described which are connected in series relation with the respective first and second mode master control switches 17 and 19. Both switch assemblies 92 and 94 are electrically configured so as to be normally closed; that is, when the switch arm 88 is in the first position, a closed electrical circuit is defined through the affected switch assembly 92 or 94 and electrical energy is permitted to flow therethrough, and when the switch arm 88 is displaced in the second position, an open electrical circuit is defined through the affected switch assembly 92 or 94 and electrical energy is prevented from flowing therethrough. Should either the first or second switch assembly 92 or 94 be disposed in the second, or open circuit, position, the flow of electrical current from the source to the motor 18 through the affected mode circuit 13 or 15 is prevented, notwithstanding the disposition of the respective master mode control switch 17 or 19 in the closed position.

Referring now to FIG. 2, the first switch assembly 92 is carried by the base portion 32 on leg member 40 intermediate the first actuator disc 70 and the right sidewall 36. The first switch assembly 92 is thus located for engagement principally with the first actuator disc 70 as the first and second actuator discs 70 and 72 synchronously advance toward the right. As heretofore described, this rightward advancement occurs when the lead screw shaft 56 is being rotated clockwise, which in turn occurs when the motor 18 is being operated in its first mode to open the door 16. By virtue of this electrical and mechanical cooperation of elements, the operation of the motor 18 in the first mode will be permitted subsequent to the closing of the first master control switch 17 until such time that the perimeter edge 74 of the rightwardly advancing first actuator disc 70 engages and depresses the switch arm 88 of the first switch assembly 92. At this point, the first switch assembly 92 defines an open circuit and prevents further operation of the motor 18 in the first mode. Further opening of the door 16 beyond this point is prevented.

In similar fashion, the second switch assembly 94 is carried by the base portion 32 intermediate the second actuator disc 72 and the left sidewall 34. Thus, the second switch assembly 94 is located for engagement principally with the second actuator disc 72 as the first and second actuator disc 70 and 72 synchronously advance toward the left. As heretofore described, the leftward advancement occurs when the lead screw shaft 56 is being rotated counterclockwise, which in turn occurs when the motor 18 is being operated in its second mode to close the door 16. Operation of the motor 18 in the second mode is permitted until the second actuator disc 72 engages and depresses the switch arm 88 of the second switch assembly 94. At this point, an open circuit occurs and operation of the motor 18 in the second mode ceases. Further closure of the door 16 beyond this point is prevented.

It is possible for either the first or second switch assembly 92 and 94 to fail and thereby not terminate motor operation when the door 16 has reached its predetermined opened or closed positions. Should this occur, the motor 18 will continue to rotate the lead screw shaft 56, and the actuator disc 70 or 72 will continue its axial advancement, "riding over" the failed switch assembly 92 or 94 and eventually jamming against the proximate sidewall 34 or 36. Mechanical damage to the limit switch 10 itself can result, as well as associated overtravel damage to the mechanical components of the door 16.

In accordance with the invention, the switching means 30 includes third and fourth switch assemblies 96 and 98 which are included in the control circuit 12 in series relation to each other and in parallel relation to the first and second mode control circuits 13 and 15 as heretofore described. Like the first and second switch assemblies 90 and 92, the third and fourth switch assemblies 96 and 98 are of the normally closed type, such that current flow through either switch assembly 96 or 98 is permitted unless the respective switch arm 88 is depressed by an advancing actuator disc 70 or 72. By virtue of the electrical interconnection of the third and fourth switch assemblies 96 and 98 in the control circuit 12, should the switch arm 88 of either the third or fourth switch assembly 96 and 98 be depressed, an open circuit between the source and both of the first and second mode circuits 13 and 15 is defined, completely terminating the flow of current through the rest of the control circuit 12.

As shown in FIG. 3, the third and fourth switch assemblies 96 and 98 are positioned in the base portion 32 on the leg member 42 which is opposite to the leg member 40 upon which the first and second switch assemblies 92 and 94 are carried. The third and fourth switch assemblies 96 and 98 are at a closer axial distance to the respective sidewall 34 or 36 than the proximate first and second switch assemblies 92 and 94. Thus, should either the first or second switch assembly 92 or 94 fail to shut off the motor 18 and halt rotation of the lead screw shaft 56, subsequent axial advancement of the actuator discs 70 and 72 will cause the perimeter edge to ultimately contact the switch arm 88 of either the third or fourth switch assembly 96 or 98, depending upon the direction of advancement. An open circuit between the source and the motor 18 will thereby terminate operation of the motor 18 before damage to the limit switch or to the door 16 occurs.

The electrical functions performed by the cooperation of the four switch assemblies 92, 94, 96, and 98 are not confined to those as heretofore described and may be varied to meet the particular operational objectives at hand. For example, the third and fourth switch assemblies 96 and 98 may be electrically configured to provide primary overtravel protection, and the first and second switch assemblies 92 and 94 may be electrically configured to control other intermediate electrical functions. For example, as the door 16 is being opened or closed, with overtravel protection being provided by the third and fourth switch assemblies 96 and 98, the first and second switch assemblies 92 and 94 can be used to selectively turn on and extinguish electrical lights. Furthermore, the power actuated device 14 may be an electrical device, such as a variable potentiometer (not shown), which is operatively connected to the motor 18 and operable between predetermined limits by the limit switch 10.

In whatever environment the limit switch 10 is used, the relative axial spacing between the actuator discs 70 and 72 as well as the relative axial spacing of the actuator discs 70 and 72 relative to the proximate switching assemblies 92, 94, 96, and 98 ultimately determine the respective limits of operation of the motor 18 and thus of the associated power actuated device 14. Since the operational objectives of various power actuated devices 14 can vary, it is desirable to be able to easily adapt the limit switch 10 to the particular operational objective desired by adjusting the relative axial dispositions of the discs 70 and 72 and switch assemblies 92, 94, 96, and 98.

In accordance with the invention, the limit switch 10 includes first adjusting means 100 (see FIG. 3) for permitting selective positioning of the actuator discs 70 and 72 along the lead screw shaft 56, as well as second adjusting means 102 (see FIG. 4) for permitting selective positioning of the switch assemblies 92, 94, 96, and 98 along the path of axial advancement of the actuator discs 70 and 72.

Referring to the first adjusting means 100, and realizing that various constructions can be used, in the illustrated embodiment, the guide plate 78 includes elongated openings 101 through which the screw bolts 80 pass to affix the guide plate 78 to the frame 20. By virtue of the openings 101, the guide plate 78 is slidable within predetermined limits (i.e. the length of the elongated openings 101) between an inward position in which the leading edge 82 engages the proximate slot (as shown in solid lines in FIG. 4) and an outward position in which the leading edge 82 is spaced outwardly beyond the perimeter edges of both actuator discs 70 and 72 (as shown in phantom lines in FIG. 4).

Operation of the actuator discs 70 and 72 when the guide plate 78 is in the inward position has heretofore been described. When the guide plate 78 is in the outward position, common rotation of the actuator discs 70 and 72 with the lead screw shaft 56 is permitted, which thereby prevents axial advancement of the actuator discs 70 and 72 in response to rotation of the lead screw shaft 56. However, each actuator disc 70 and 72 is free to be independently rotated relative to the lead screw shaft 56 and thus independently positioned along the lead screw shaft 56.

The number and spacing of slots 76 about the circumference of the perimeter edge 74 of each actuator disc 70 and 72 affects the exactness with which each actuator disc 70 and 72 may be positioned along the lead screw shaft 56. For example, should seventy complete rotations of each actuator disc 70 and 72 relative to the lead screw shaft 56 be necessary to advance each of the actuator discs 70 and 72 from one end 58 of the lead screw shaft 56 to the other end 60, one slot would permit seventy adjustable positions, four slots would permit 280 adjustable positions, forty slots would permit 2800 adjustable positions, and so on. Thus, as the number of slots 76 increases, the resolution of adjustment thereby significantly increases.

Referring next to the second adjusting means 102 (see FIG. 4), a generally T-shaped groove 103 and 104 is integral with each leg member 40 and 42 and runs longitudinally along the entirety of the base 32. Runner means 105 is provided for sliding engagement with each groove 103 and 104 and each switch assembly 92, 94, 96, and 98 is mounted on a respective runner means 105. Locking means 106 is provided for selectively preventing the sliding movement, thereby locking the switch assemblies 92, 94, 96, and 98 into the desired operational position, and for freeing the runner means 105 for sliding movement should future adjustment be required.

While the runner means 105 may be variously constructed, in the illustrated embodiment, an H-shaped mounting block 108 is provided, having a lower body portion 109 slidably engaged within the groove 103 or 104 and an integral upper body member 110 extending outwardly beyond the groove 103 or 104. The switch assembly 92, 94, 96, or 98 is munted on the upper body member 110.

The locking means 106 may also be variously constructed. In the illustrated embodiment, a screw member 111 has an upper screw portion 112 which secures the switch assembly 92, 94, 96, or 98 to the upper body member 110 and a lower screw portion 113 which projects outwardly of the lower body portion 109 of the mounting block 108. Rotation of the screw member 111 displaces the lower screw portion 113 between an abutting relationship with the groove 103 or 104 (as shown in phantom lines in FIG. 4), thereby locking the mounting block 108 in position, and a non-abutting relationship with the groove 103 or 104 (as shown in solid lines in FIG. 4), thereby freeing the mounting block 108 for sliding movement in the groove 103 or 104.

As should now be apparent, each of the actuator discs 70 and 72 and each of the switch assemblies 92, 94, 96, and 98 are independently adjustable to permit a wide range of operation for the limit switch 10. Furthermore, the base 32 is of one piece, extruded construction and permits a wide selection in the overall length of the limit switch 10 desired merely by preselecting the length of the extrusion.

Although but one embodiment of the present invention has been illustrated and described, it will be apparent to those skilled in the art that various changes and modifications may be made therein without departing from the spirit of the invention or from the scope of the appended claims.

I claim:

1. A limit switch comprising:

a frame member including a base portion and oppositely spaced sidewalls extending from said base portion;

lead screw means transversely supported by said sidewalls and rotatable relative to said frame member;

coupling means for connecting said lead screw means to a drive source for rotating said lead screw means;

control means threadably engaged upon said lead screw means;

retaining means operatively engageable with said control means and including adjusting means selectively operatively engaging and disengaging said retaining means with said control means for preventing rotation of said control means with said lead screw means while permitting axial advancement of said control means along said lead screw means in response to rotation of said lead screw means and for freeing said control means for rotation and selective positioning thereof along said lead screw means;

groove means integral with said base portion;

runner means for sliding engagement within said groove means;

locking means for selectively preventing sliding movement of said runner means within said groove means and for freeing said runner means for the sliding movement;

switching means carried by said runner means and located in the path of axial advancement of said control means for operation between a first switch position and a second switch position in response to selective engagement with and disengagement from said control means; and whereby said control means and said switching means are independently adjustable to permit a wide range of operation for the limit switch.

2. A limit switch according to claim 1:

wherein said groove runs longitudinally along the entirety of said base portion;

wherein said runner means includes a lower body member slidably engaged within said groove and an integral upper body member extending outwardly beyond said groove; and wherein said switching means is mounted upon said upper body member.

3. A limit switch according to claim 1:

wherein said base portion includes an elongated extruded metallic member having two generally sloping leg members thereby defining a inverted V-shape form for said base portion;

wherein said groove means includes a groove integral with each of said leg members running longitudinally along the entirety of said metallic member, wherein said runner means includes a block member operative for sliding engagement with each of said grooves;

wherein said locking means is individually operatively connected with each of said block members for selectively preventing sliding movement of each of said block members within each of said grooves and for freeing each of said block members for said movement; and wherein said switching means includes a switch assembly carried by each of said block members in each of said grooves.

4. A limit switch according to claim 3:

wherein each of said leg members includes an integral flanged foot running longitudinally along the entirety of said metallic member and making supportive contact with the ground.

5. A limit switch according to claim 1:

wherein said base portion includes a first surface area and a second surface area, said first and second surface areas being generally oppositely spaced along and equidistant to the axis of rotation of said lead screw means;

wherein said groove means includes a first and second groove integral with and disposed longitudinally along, respectively, said first and said second surface areas;

wherein said runner means includes:

first and second block members operative for independent sliding engagement within said first groove;

third and fourth block members operative for independent sliding engagement within said second groove;

wherein said locking means is individually operatively connected with each of said block members for selectively preventing sliding movement of the respective one of said block members within the respective one of said grooves and for freeing said respective block members for sliding movement within said respective groove; and wherein said switching means includes first, second, third, and fourth switching means carried by, respectively, said first, second, third, and fourth block members.

6. A limit switch according to claim 1:

wherein said locking means includes a screw member having an upper screw portion attaching said switching means to said upper body portion and a lower screw portion projecting outwardly of said lower body portion and displaceable in response to rotation of said screw member between an abutting position with said groove to resist sliding movement of said runner means within said groove and a non-abutting position with said groove to free said runner means for sliding movement within said groove.

7. A limit switch comprising:

a frame member including a base portion and oppositely spaced sidewalls extending from said base portion;

a lead screw shaft transversely supported by said sidewalls and adapted to be connected to a drive source for rotation relative to said frame member;

first and second actuator discs threadably engaging said lead screw shaft in a normally spaced-apart relationship to each other, each of said first and second actuator discs having outer perimeter edges including a plurality of generally axial slots spaced about the circumference thereof;

a guide plate mounted on said frame and positioned generally longitudinally along and spaced from said lead screw shaft, said guide plate including a leading edge portion movable between an engaged position with one of said axial slots on each of said first and second actuator discs, which thereby prevents rotation of said first and second actuator discs while permitting sliding movement of said engaged ones of said axial slots along said leading edge portion as said first and second actuator discs axially advance along said lead screw shaft in response to rotation of said lead screw shaft, and a disengaged position from all of said axial slots, which thereby permits independent rotation of each of said first and second actuator discs relative to said lead screw shaft to thereby individually position each of said first and second actuator discs axially along said lead screw shaft;

a groove integral with said base portion and running longitudinally along the entirety thereof;

a first and second runner member, each having a lower body portion slidably engaged with said groove and an integral upper body portion extending outwardly beyond said groove;

locking means for individually selectively preventing the sliding movement of each of said first and second runner members along said groove and for freeing each of said first and second runner members for the sliding movement; and first switching means carried by said upper body portion of said first runner member and second switching means carried by said upper body portion of said second runner member, said first and second switching means being adjustably located in the path of axial movement of said peripheral edges of said first and second actuator discs for selective engagement therewith and disengagement therefrom, said first and second switching means further being independently operative for movement between a normally biased first switch position when disengaged from either of said peripheral edges and a second switch position when in engagement with one of said peripheral edges, said first switching means being positioned for principal engagement with said first actuator disc and said second switching means being positioned for principal engagement with said second actuator disc; and whereby each of said actuator discs and each of said switching means are independently adjustable upon said frame member to permit a wide range of operation for the limit switch.

8. A limit switch comprising:

a frame member including an elongated extruded metallic base member having first and second generally sloping leg members thereby defining an inverted V-shaped form, said first and second leg members spaced oppositely along and equidistant to the axis of rotation of said lead screw shaft, each of said first and second leg members including an integral flanged foot running longitudinally along the entirety of said metallic base member and making supportive contact with the ground, and oppositely spaced sidewalls attached on and extending upwardly from said metallic base member;

a lead screw shaft transversely supported by said sidewalls and adapted to be connected to a drive source for rotation relative to said frame member;

first and second actuator discs threadably engaging said lead screw shaft in a normally spaced-apart relationship to each other, each of said first and second actuator discs having outer perimeter edges including a plurality of generally axial slots spaced about the circumference thereof;

a guide plate mounted on said frame and positioned generally longitudinally along and spaced from said lead screw shaft, said guide plate including a leading edge portion movable between an engaged position with one of said axial slots on each of said first and second actuator discs, which thereby prevents rotation of said first and second actuator discs while permitting sliding movement of said engaged ones of said axial slots along said leading edge portion as said first and second actuator discs axially advance along said lead screw shaft in response to rotation of said lead screw shaft, and a disengaged position from all of said axial slots, which thereby permits independent rotation of each of said first and second actuator discs relative to said lead screw shaft to thereby individually position each of said first and second actuator discs axially along said lead screw shaft;

a first and second groove integral with and disposed longitudinally along, respectively, the entirety of said first and second leg members;

a first and second runner member, each having a lower body portion slidably engaged with said first groove and an integral upper body portion extending outwardly beyond said first groove;

a third and a fourth runner member, each having a lower body portion slidably engaged with said second groove and an integral upper body portion extending outwardly beyond said second groove;

locking means on each of said first, second, third and fourth runner members for selectively preventing sliding movement of the respective one of said runner members within the respective one of said grooves and for freeing said respective runner member for the sliding movement within said respective groove;

first switching means carried by said upper body portion of said first runner member, second switching means carried by said upper body portion of said second runner member, said first and second switching means being adjustably located in the path of axial movement of said peripheral edges of said first and second actuator discs for selective engagement therewith and disengagement therefrom, said first and second switching means independently operative for movement between a normally biased first switch position when disengaged from either of said peripheral edges and a second switch position when in engagement with one of said peripheral edges, said first switching means being positioned for principal engagement with said first actuator disc and said second switching means being positioned for principal engagement with said second actuator disc; and third switching means carried by said upper body portion of said third runner member and fourth switching means carried by said upper body portion of said fourth runner member, said third and fourth switching means being located in the path of axial movement of said first and second actuator discs and independently operative for movement between a normally biased first switch position when disengaged from both of said peripheral edges and a second switch position when in engagement with one of said peripheral edges, said third switching means being located for principal engagement with said first actuator disc and said fourth switching means being located for principal engagement with said second actuator disc; and whereby each of said actuator discs and each of said switching means are independently adjustable upon said frame member to permit a wide range of operation for the limit switch.

9. A limit switch according to claim 8 wherein said locking means includes a screw member having an upper screw portion attaching said respective switching means upon said respective upper body portion and a lower screw portion projecting outwardly of said respective lower body portion and displaceable in response to rotation of said screw member between an abutting position with said respective groove to resist sliding movement of said respective runner member within said respective groove and a non-abutting position with said respective groove to free said respective runner member for sliding movement within said respective groove.

10. A limit switch comprising:

a frame member including a base portion and oppositely spaced sidewalls extending from said base portion;

lead screw means transversely supported by said sidewalls and rotatable relative to said frame member;

coupling means for connecting said lead screw means to a drive source for rotating said lead screw means;

control means threadably engaged upon said lead screw means;

retaining means operatively engaged with said control means for preventing rotation of said control means with said lead screw means while permitting axial advancement of said control means along said lead screw means in response to rotation of said lead screw means;

a groove integral with said base portion, runner means for sliding engagement within said groove, and locking means for selectively preventing sliding movement of said runner means within said groove and for freeing said runner means for the sliding movement; and switching means carried by said runner means and located in the path of axial movement of said control means for operation between a first switch position and a second switch position in response to selective engagement with and disengagement from said control means.

11. A limit switch according to claim 10:

wherein said groove runs longitudinally along the entirety of said base portion;

wherein said runner means includes a lower body member slidably engaged with said groove and an integral upper body member extending outwardly beyond said groove; and wherein said switching means is mounted upon said upper body member.

12. A limit switch according to claim 11:

wherein said locking means includes a screw member having an upper screw portion attaching said switching means to said upper body portion and a lower screw portion projecting outwardly of said lower body portion and displaceable in response to rotation of said screw member between an abutting position with said groove to resist sliding movement of said runner means within said groove and a nonabutting position with said groove to free said runner means for sliding movement within said groove.

13. A limit switch according to claim 10:

wherein said base portion includes a first surface area and a second surface area, said first and second surface areas being generally oppositely spaced along and equidistant to the axis of rotation of said lead screw means;

and further including a second groove in addition to said first mentioned groove, said first and second grooves being integral with and disposed longitudinally along, respectively, said first and said second surface areas;

wherein said runner means includes:

first and second runner members for independent sliding engagement within said first groove;

third and fourth runner members for independent sliding engagement within said second groove; and wherein said locking means is associated with each of said runner members for individually selectively preventing sliding movement of the respective one of said runner members within the respective one of said grooves and for freeing said respective runner members for sliding movement within said respective groove; and wherein said switching means includes first, second, third, and fourth switching means carried by, respectively, said first, second, third, and fourth runner members.

14. A limit switch comprising:

a frame member having a base portion including an elongated extruded metallic member having oppositely spaced sidewalls and two generally sloping leg members thereby defining an inverted V-shaped form for said base portion;

lead screw means transversely supported by sidewalls and rotatable relative to said frame member;

coupling means for connecting said lead screw means to a drive source for rotating said lead screw means;

control means threadably engaged upon said lead screw means;

retaining means operatively engaged with said control means for preventing rotation of said control means with said lead screw means while permitting axial advancement of said control means along said lead screw means in response to rotation of said lead screw means;

a groove integral with each of said leg members running longitudinally along the entirety of said metallic member, runner means for sliding engagement with each of said grooves, locking means for selectively preventing sliding movement of each of said runner means within each of said grooves and for freeing each of said runner means for said movement; and switching means carried by said runner means and located in the path of axial advancement of said control means for operation between a first switch position and a second switch position in response to selective engagement with and disengagement from said control means.

15. A limit switch according to claim 14:

wherein each of said leg members includes an integral flanged foot running longitudinally along the entirety of said metallic member and making supportive contact with the ground.

* * * * *